United States Patent [19]

Parker

[11] 4,369,972

[45] Jan. 25, 1983

[54] CARD DEALER WHEEL ASSEMBLY WITH ADJUSTABLE ARM

[76] Inventor: Richard A. Parker, 2221 Coolridge Rd., Holt, Mich. 48842

[21] Appl. No.: 236,323

[22] Filed: Feb. 20, 1981

[51] Int. Cl.[3] ..... A63F 1/10

[52] U.S. Cl. ..... 273/148 A; 211/53

[58] Field of Search ..... 273/148 A, 149, 150; 211/53, 56, 58, 77, 78

[56] References Cited

U.S. PATENT DOCUMENTS

| | | | |
|---|---|---|---|
| D. 161,157 | 12/1950 | Browning | D34/13 |
| D. 164,641 | 9/1951 | Jones | 273/148 A X |
| D. 168,712 | 1/1953 | Rittenhouse | D34/13 |
| 1,184,196 | 5/1916 | Michell . | |
| 1,246,297 | 11/1917 | Michell . | |
| 1,545,650 | 7/1925 | Frank | 273/150 |
| 1,673,825 | 6/1928 | Hoffmann . | |
| 1,785,876 | 12/1930 | Pilates | 124/7 X |
| 3,185,482 | 5/1965 | Russell . | |
| 3,216,722 | 11/1965 | Odom | 272/73 |

*Primary Examiner*—Anton O. Oechsle

*Attorney, Agent, or Firm*—Miller, Morriss and Pappas

[57] ABSTRACT

A card dealer wheel assembly having a rotatable adjustable extension arm is provided which is selectively adapted for use on various sizes of card tables so as to selectively deliver cards proximate to card players positioned around the perimeter of a card table. The elongate rotatable adjustable extension arm is provided with a plurality of spaced-apart adjustment holds therethrough which extend longitudinally therealong from one end thereof. A card holder and dispensing assembly is fixedly mounted at the end of the adjustable extension arm opposite the adjustment holes provided therethrough. A central support base member is provided for selective rotatable supporting engagement with the elongate adjustable extension arm so as to permit selective incremental rotation of the card holder and dispensing assembly between card player positions around the perimeter of a card table. The central support base member is adapted for selective engagement with selected of the adjustment holes provided in the extension arm so as to selectively vary the operative radial length of the extension arm in order to adapt the card dealer wheel assembly for use on various sizes of tables.

2 Claims, 11 Drawing Figures

CARD DEALER WHEEL ASSEMBLY WITH ADJUSTABLE ARM

SUMMARY OF THE INVENTION

This invention relates to a card dealer wheel assembly having a rotatable adjustable extension arm which is selectively adapted for use on various sizes of card tables so as to selectively deliver cards proximate to card players positioned around the perimeter of a card table. The elongate rotatable adjustable extension arm is provided with a plurality of spaced-apart adjustment holes therethrough which extend longitudinally therealong from one end thereof. A card holder and dispensing assembly is fixedly mounted at the end of the adjustable extension arm opposite the adjustment holes provided therethrough.

A central support base member is provided for selective rotatable supporting engagement with the elongate adjustable extension arm so as to permit selective incremental rotation of the card holder and dispensing assembly between card player positions around the perimeter of a card table. The central support base member is adapted for selective engagement with selected of the adjustment holes provided in the extension arm so as to selectively vary the operative radial length of the extension arm in order to adapt the card dealer wheel assembly for use on various sizes of tables.

In one embodiment of the invention, the card holder and dispensing assembly comprises a two compartment card rack wherein one compartment is for a supply or deck of cards which each player draws from and the other compartment is for "discards" that each player makes during the playing of any particular game being played. Further, the compartments are configured so that the cards can be easily removed only one at a time.

A need has existed for a card dealer wheel assembly which greatly facilitates and speeds up the playing of such card games as "rummy", "canasta" and the like, by selectively moving the cards within easy reach of each player when his respective turn of play occurs.

A further need has existed for a card dealer wheel assembly whereby the cards are easily moved around the table from player to player without the actual handling of the cards.

Yet another need has existed for a card dealer wheel assembly which is provided with a selectively adjustable rotatable extension arm so as to adapt it for use on various sizes of card tables.

Nowhere in the known prior art is there shown a card dealer wheel assembly having a rotatable adjustable extension arm provided with a card holder and dispensing assembly at the outer end thereof whereby the cards can be selectively moved from player to player during the card game.

It is therefore an object of this invention to provide a card dealer wheel assembly having a rotatable adjustable extension arm provided with a card holder and dispensing assembly at the outer end thereof whereby the cards can be selectively moved from player to player during the card game so as to greatly facilitate the selection and discarding of cards by each player as his turn occurs under the rules of the particular card game being played.

Another object of this invention is to provide a card dealer wheel assembly having an adjustable extension arm whereby the extension arm can be radially lengthened in relation to the central support base member so as to position the card holder and dispenser assembly proximate to the outer perimeter of the table regardless of the size of the table.

Other objects and advantages found in the construction of the invention will be apparent from a consideration of the following specification in connection with the appended claims and the accompanying drawings.

IN THE DRAWINGS

SPECIFIC DESCRIPTION

Figure 1:
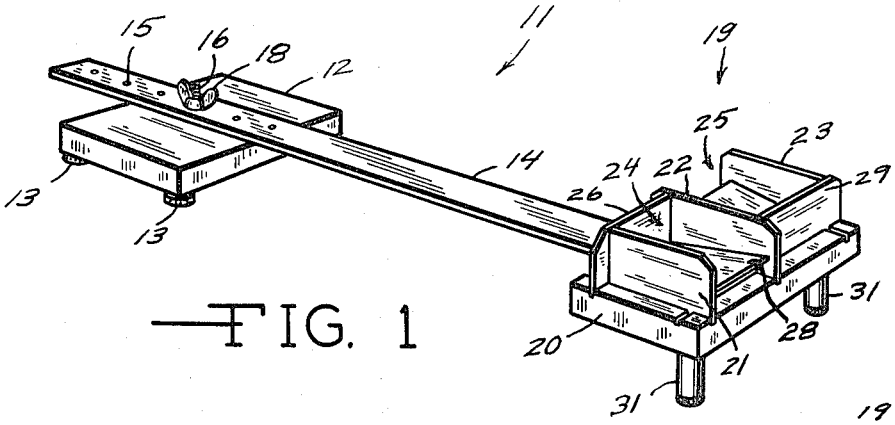
FIG. 1 is a left perspective view of the card dealer wheel assembly showing the rotatable adjustable extension arm provided with a card holder and dispensing assembly at the outer end thereof.
Figure 2:
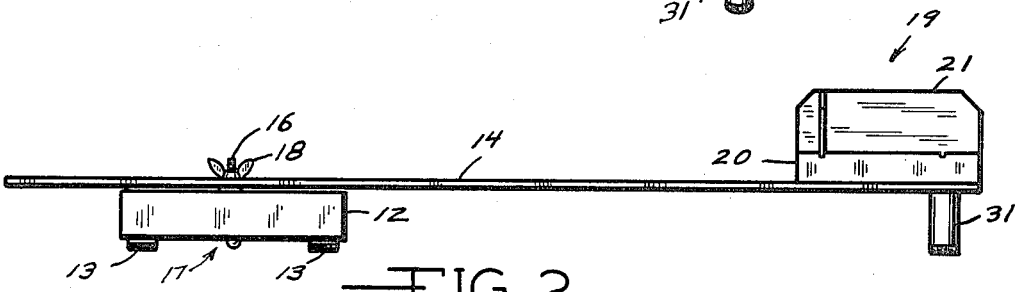
FIG. 2 is a side elevation view thereof showing the extension arm rotatably connected to the central support base member.
Figure 3:
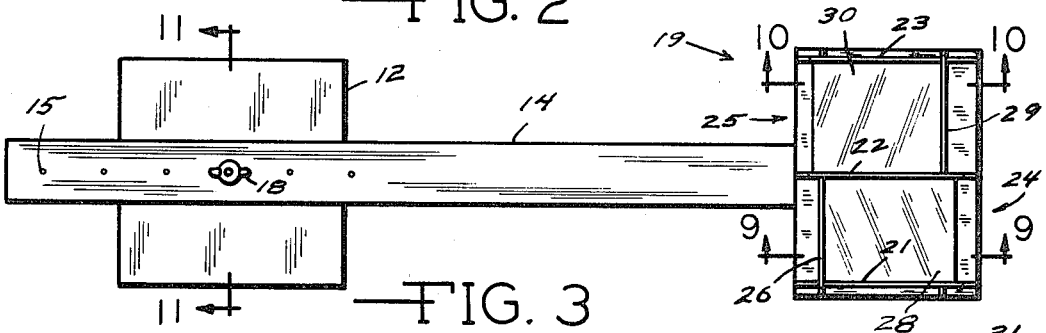
FIG. 3 is a top view thereof.
Figure 4:
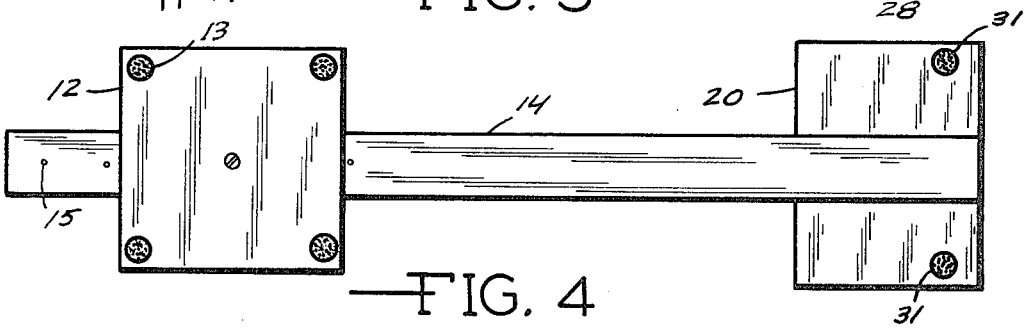
FIG. 4 is a bottom view thereof.
Figure 5:
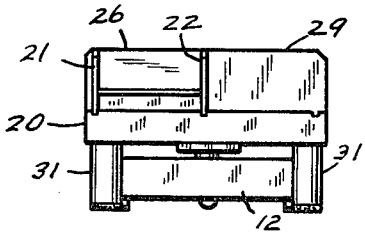
FIG. 5 is a right end view thereof.
Figure 6:
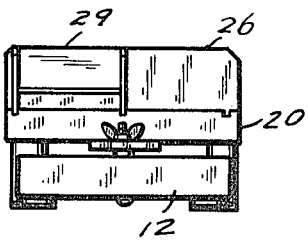
FIG. 6 is a left end view thereof.

As shown in the drawings, the card dealer wheel assembly 11 consists of a central support base member 12 which has a generally flat square configuration and is provided with support pegs 13 positioned at each corner thereof. The support base member 12 is preferably fabricated from a heavy wood material but can be made from plastic or metal as desired as long as it is sufficiently heavy so as to provide an anchoring support function.

An elongate extension arm 14 is provided for rotatable engagement with the support base member 12. The extension arm 14 is provided with a plurality of adjustment holes 15 extending longitudinally therealong from one end thereof. An upwardly extending threaded bolt 16 is provided through a centrally positioned hole 17 provided through the central base member 12 so as to engage a selected one of the adjustment holes 15 provided in the extension arm 14.

As shown generally in the drawings, a lock nut 18 is provided in engagement with the bolt 16 so as to rotatably retain the extension arm 14 in rotatable engagement with the support base member 12. It is considered to be within the scope of the invention to provide other means to rotatably support the extension arm 14 on the support base member. For instance, a threaded upwardly extending rod (not shown) could be fixedly provided on the support base member in place of the bolt member 17.

As shown generally in the drawings and more specifically in FIGS. 2 through 4, and 9, a card holder and dispenser assembly 19 is fixedly positioned at the outer end of the extension arm 14. The card holder and dispensing assembly 19 consists of a substantially rectangular flat support member 20 which is fixedly attached to the upper surface of the end of the extension arm 14. Upwardly extending panels 21, 22 and 23 are provided on the support member 20 which are parallel to the extension arm 14 so as to provide two card holder compartments 24 and 25, respectively, on the support member 20.

Figure 9:
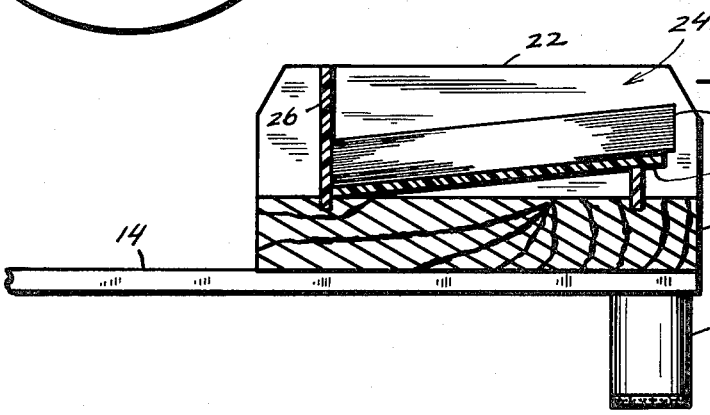
FIG. 9 is a schematic cross-sectional view of the card holder and dispensing assembly taken on line 9—9 of FIG. 3.

As specifically shown in FIG. 9, a first card holder compartment 24 is provided with a rear closure wall 26 and is open towards the player position proximate thereto so as to facilitate the removal of a card from the card deck 27 positioned therein. An upwardly inclined card deck support bottom wall 28 is provided in the first card holder compartment 24 and is upwardly inclined toward the open end of the card compartment 24 so as to maintain the card deck 27 in an upwardly inclined position toward the position of the player, thus facilitating the removal of a single card at a time from the deck by the player.

Figure 10:
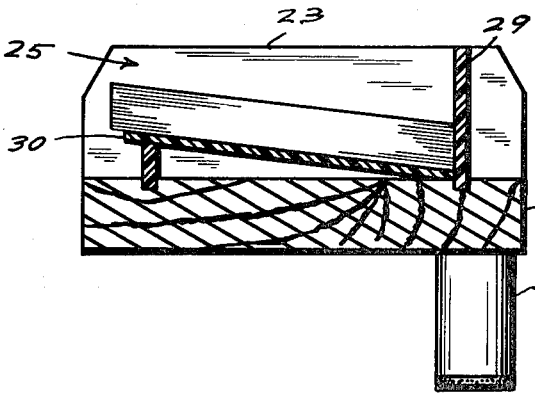
FIG. 10 is a schematic cross-sectional view of the card holder and dispensing assembly taken on line 10—10 of FIG. 3.
Figure 11:
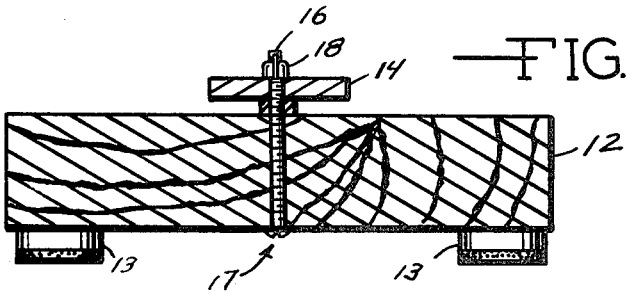
FIG. 11 is a schematic cross-sectional view of the central support base member showing the extension arm rotatably connected thereto taken on line 11—11 of FIG. 3.

As specifically shown in FIG. 10, a second card compartment 25 is intended to receive card "discards" from players during the playing of a card game. The card compartment 25 is provided with a rear wall 29 and card deck support bottom wall 30 which is upwardly inclined away from the player position. Although a specific configuration has been described herein for the card holder and dispenser assembly 19, it is within the scope of the invention to provide a single or multiple compartment card holder assembly depending on the requirements of the card game being played. Further, the panels 21, 22 and 23 and rear wall closure walls 26 and 29 are preferably fabricated from clear plastic so that the cards are clearly visible to the players.

Downwardly extending card holder assembly support legs 31 are provided on the card holder and dispenser assembly 19 so as to support the card holder assembly 19 in its playing position on the table 32. The support legs 31 are configured to permit sliding movement thereof across the surface of the table 32 as the extension arm 14 is rotated so as to move the card holder and dispenser assembly 19 from one player to another as the game progresses. However, it is within the scope of the invention to provide ball bearings or rollers in place of or in association with the support legs 31 so as to facilitate movement thereof over the surface of the table.

Figure 7:
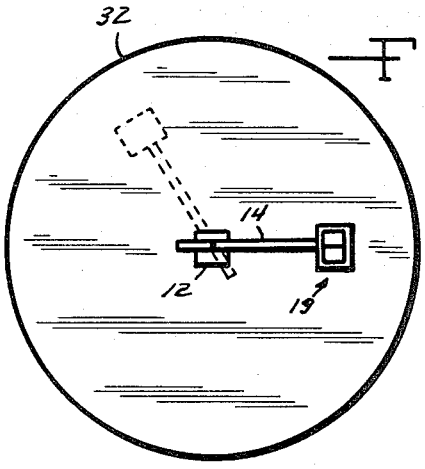
FIG. 7 is a top schematic view of the card dealer wheel assembly showing the adjustable extension arm radially extended for use on a large table.
Figure 8:
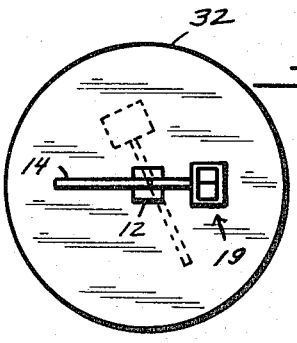
FIG. 8 is a top schematic view showing the adjustable extension arm radially retracted for use on a small table.

As shown in FIGS. 7 and 8, the operative use position of the card dealer wheel assembly 11 is upon a card table 32. In FIG. 7, the card delear wheel assembly 11 is shown on a larger table. The support base 12 is centrally positioned on the table. By use of the adjustment holes 15, the radial length of the extension arm 14 is extended so as to position the card holder and dispenser assembly 19 proximate to the outer perimeter of the table around which the players are seated. In FIG. 8, the radial length of the extension arm 14 is shortened so as to adapt the card dealer wheel assembly 11 for use on a smaller table. As shown in phantom-line, the extension arm 14 and the card holder and dispenser assembly 19 affixed thereto can be manually rotated to any desired position on the table surface. Although not shown in the drawings, it is within the scope of the invention that the card dealer wheel assembly be motorized so that the extension arm can be electronically rotated as desired.

Generally, the card players select and/or discard cards on a sequential basis as their turn to play arises. Thus, when it is a player's turn to select and/or discard a card, the extension arm 14 is rotated until the card holder and dispenser assembly 19 is positioned directly in front of and proximate to the player involved. The player thus does not have to reach for the cards and the progress of the game is greatly expedited. When the player has completed his turn at play, he then pushes and/or lifts the extension arm 14 so as to cause rotation thereof to move the card holder and dispenser assembly 19 to a position in front of the next adjacent active player seated around the table 32. If desired, the dealer can manually rotate the extension arm 14 or the player whose turn to play has arisen can also cause such movement as desired.

In addition, not only does this invention speed up the progress of the game by positioning the cards proximate to and in front of each player when his turn to play arises, but the manual handling of the card decks is eliminated when the decks are being moved from player to player. The cards are thus kept in order and errors in play are avoided.

The extension arm 14 can be easily disengaged from the base support member 12, so as to provide ease of storage. This further adds to the utility of the invention.

It is thus seen that a highly utilitarian card dealer wheel assembly is provided which facilitates and expedites the playing of card games wherein card players are seated around a card table and are required to sequentially select and discard cards during the playing of the card game. The card dealer wheel assembly consists of an elongate rotatable adjustable extension arm. The extension arm is provided with a plurality of spaced-apart adjustment holes therethrough which extend longitudinally therealong from one end thereof. A card holder and dispensing assembly is fixedly mounted at one end of the extension arm opposite the adjustment holes. A central support base member is provided which is adapted for rotatable supporting engagement of the extension arm through selected of the adjustment holes provided therethrough so as to selectively vary the operative radial length of the extension arm.

Generally the card holder and dispensing assembly defines at least one card holder compartment therein. In the embodiment of the invention shown in the drawings, the card holder and dispensing assembly defines first and second card holder compartments therein. The first card holder compartment is open at one end thereof opposite the central support base member. The first card holder compartment is provided with a bottom wall being upwardly inclined toward the open end of the first card holder compartment. The second card holder compartment is open at one end thereof toward the central support base member. The second card holder compartment is provided with a bottom wall being upwardly inclined toward the open end of the second card holder compartment. The card holder and dispensing assembly is provided with downwardly extending support means which are adapted to support the card holder and dispensing assembly in its operative use position on a card table.

Various other modifications of the invention may be made without department from the principle thereof. Each of the modifications is to be considered as included in the hereinafter appended claims, unless these claims by their language expressly provide otherwise.

I claim:

1. In a card dealer wheel assembly for use on card tables comprising:

an elongate rotatable adjustable extension arm, said extension arm provided with a plurality of spaced-apart adjustment holes therethrough extending longitudinally therealong from one end thereof;

a card holder and dispensing assembly fixedly mounted at one end of said extension arm opposite said adjustment holes, said card holder and dispensing assembly defining first and second card holder compartments therein, said first card holder compartment being open at one end thereof opposite said central support base member, said first card holder compartment provided with a bottom wall being upwardly inclined toward said open end of said first card holder compartment, said second card holder compartment being open at one end thereof toward said central support base member, said second card holder compartment provided with a bottom wall being upwardly inclined toward said open end of said second card holder compartment; and a central support base member, said central support base member adapted for rotatable supporting engagement of said extension arm through selected of said adjustment holes so as to selectively vary the operative radial length of said extension arm.

2. In the card dealer wheel assembly of claim 1 wherein said card holder and dispensing assembly is provided with downwardly extending support means adapted to support said card holder and dispensing assembly in its operative use position on a card table.

* * * * *